United States Patent [19]

Noyes

[11] 4,015,382

[45] Apr. 5, 1977

[54] REINFORCED DOOR FRAME

[75] Inventor: Harry M. Noyes, McKean, Pa.

[73] Assignee: Fenestra, Erie, Pa.

[22] Filed: Aug. 10, 1976

[21] Appl. No.: 713,188

[52] U.S. Cl. ..... 52/204; 49/504; 52/213

[51] Int. Cl.[2] ..... E06B 1/04

[58] Field of Search ..... 49/504; 52/204–211, 52/213

[56] References Cited

UNITED STATES PATENTS

| | | | |
|---|---|---|---|
| 3,299,592 | 1/1967 | Cable | 52/213 |
| 3,385,004 | 5/1968 | Oehler et al. | 49/504 |
| 3,429,076 | 2/1969 | Fortsch et al. | 49/504 |
| 3,721,055 | 3/1973 | Jerchower | 49/504 |
| 3,769,773 | 11/1973 | Mochizuki | 49/504 X |

*Primary Examiner*—J. Karl Bell

[57] ABSTRACT

A door frame made up of two jamb sections and a head section connected together to fit into a rough door opening. The sections are each made up of an elongated, generally channel-shaped member having two spaced legs and an elongated, generally Z-shaped member having a flat surface disposed parallel to the legs of the channel. Surfaces of the Z-shaped member are supported in spaced, parallel relation to the surfaces of the channel member, providing spaces to receive wall material therebetween.

5 Claims, 6 Drawing Figures

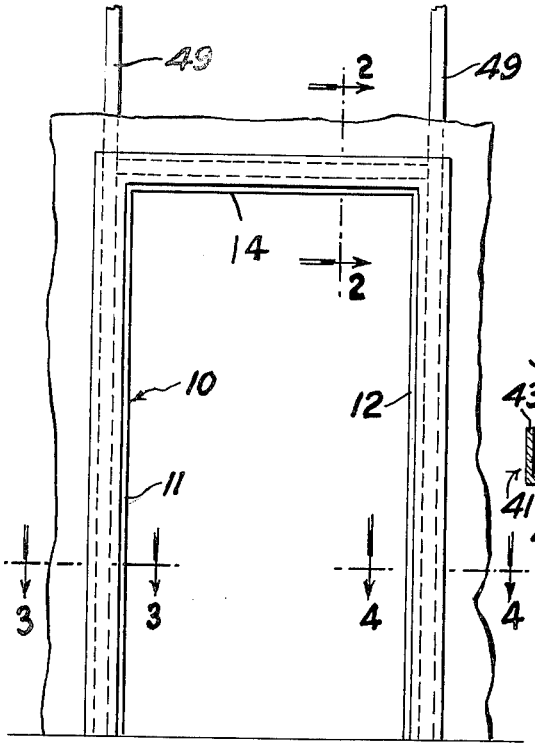
FIG. 1.
FIG. 2.
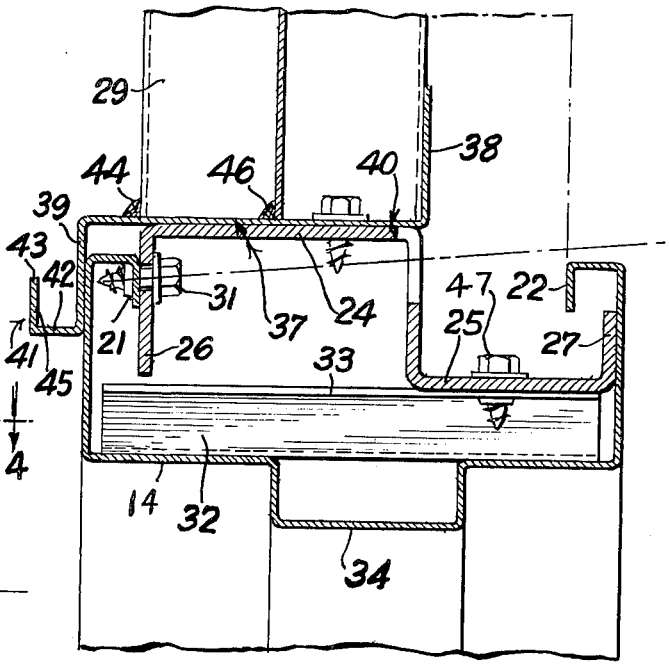
FIG. 4.
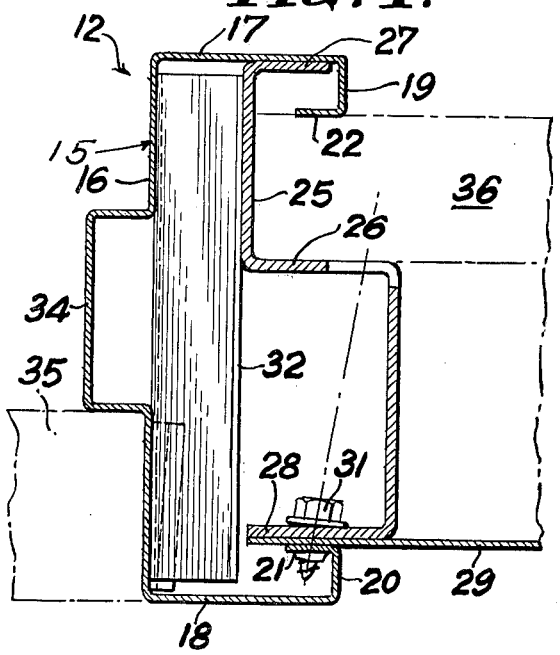
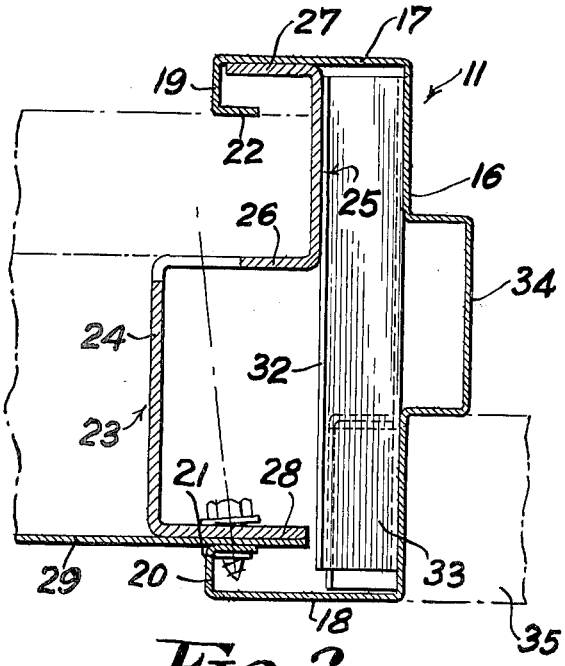
FIG. 3.

REINFORCED DOOR FRAME

GENERAL DESCRIPTION OF INVENTION

The door frame disclosed herein is of the general type disclosed in U.S. Pat. No. 3,385,004 which shows a door frame made up of generally channel-shaped members with a channel-shaped subframe/anchor for holding wall material in spaced relation and to affix subframe/wall anchor assembly readily between the structural girder and the concrete floor. The present invention provides an improvement in that the subframe/anchor is generally Z-shaped, fixed to the channel-shaped member, rigidly holding the wall material and door/frame assembly in place.

REFERENCE TO PRIOR ART

This disclosure constitutes an improvement over U.S. Letters Pat. No. 3,385,004, issued May 29, 1968 and assigned to Fenestra, Inc. of Chicago, Illinois.

OBJECTS OF THE INVENTION

It is an object of the invention to provide an improved door frame structure.

Another object of the invention is to provide a door frame structure for metal door frame that is fire resistant and suitable for use in a dry wall door opening.

Another object of the invention is to provide an improved door frame.

Another object of the invention is to provide a door frame structure that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF DRAWINGS

FIG. 1 is a front view of a door opening using the door frame according to the invention.

FIG. 2 is a cross-sectional view taken on line 2—2 of FIG. 1.

FIG. 3 is a cross-sectional view taken on line 3—3 of FIG. 1.

FIG. 4 is a cross-sectional view taken on line 4—4 of FIG. 1.

DETAILED DESCRIPTION OF DRAWINGS

Figure 5:
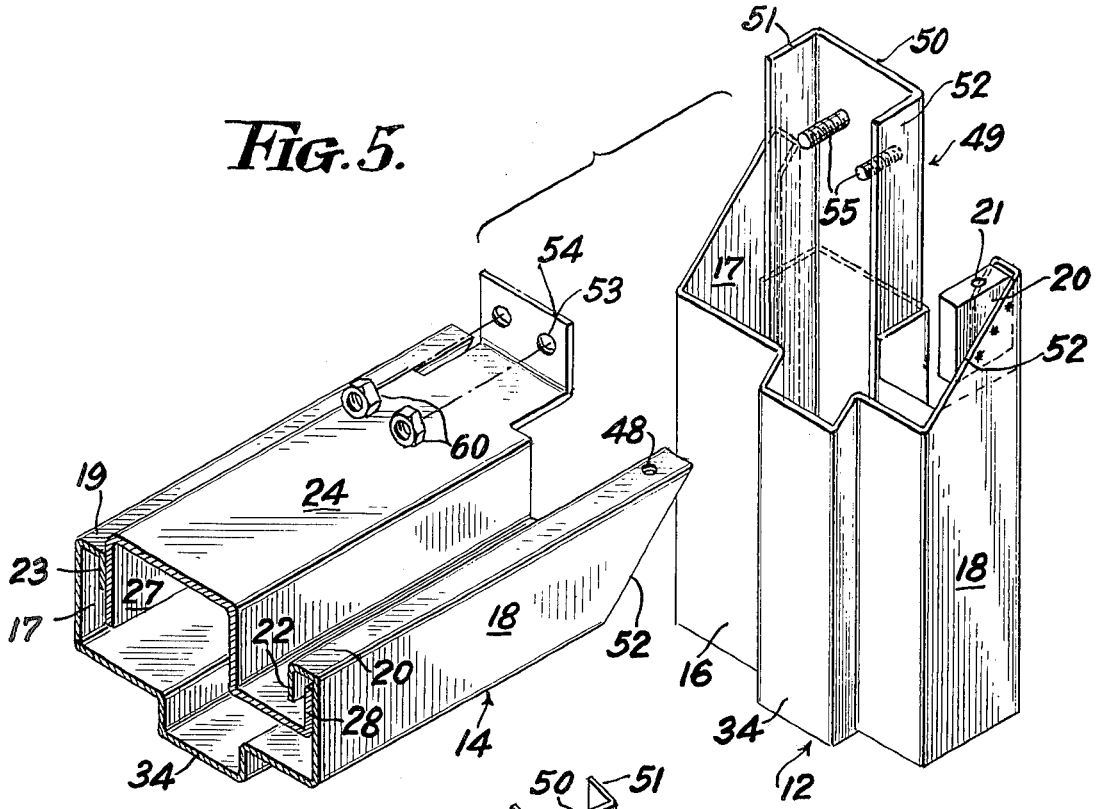
FIG. 5 is an enlarged, exploded view of a corner section joint according to the invention.
Figure 6:
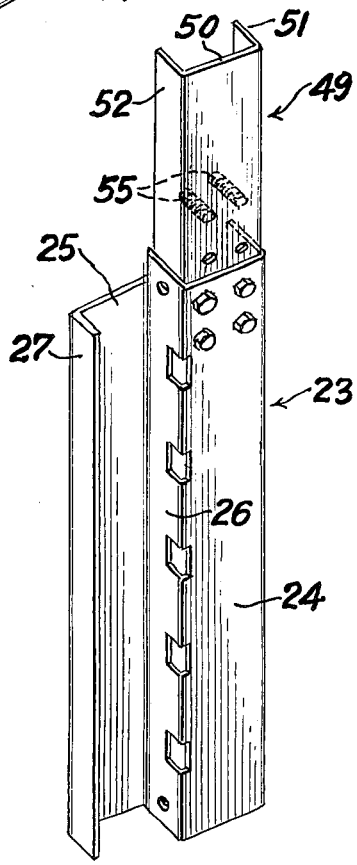
FIG. 6 is an enlarged view of sub-frame members.

Now, with more particular reference to the drawing, the door frame 10 is made generally of a strike jamb section 11, a hinge jamb section 12, connected together at the top by a head section 14. The strike section, head section and hinge section each have a generally channel-shaped member 15 which has an intermediate member 16 and two legs 17 and 18 bent generally at right angles to the intermediate section 17 and disposed in planes parallel to each other. The legs 17 and 18 each have inwardly-turned ends 19 and 20, and the distal ends of the end members 19 and 20 are bent toward the intermediate member 16 at right angles to members 19 and 20, forming end members 21 and 22. A subframe/anchor member or spacer 23, generally Z-shaped, extends the full length of the channel members 15. The Z-shaped spacer member 23 has intermediate members 24 and 25 connected together by the connecting member 26 and the outer ends 27 and 28 of the Z-shaped member, bent at right angles to the members 24 and 25 and parallel to the members 21 and 22. The member 27 rests on the inner side of the leg 17 and the end 28 defines a space between the end member 21 and itself to receive the metal siding 29. The metal siding 29 is clamped to the legs 28 and the ends 21 by the self-drilling screws 31. A stiffener 32 may be in the form of Z-shaped stiffener members fixed to the inner side of intermediate member 16 and a hinge stiffener and a masonry box 33 is provided.

The intermediate parts 16 of the channel members are formed in a door stop or rib 34 against which a door 35 may rest. Wallboard 36 of a conventional type may be supported between end members 22 and connecting member 26. Intermediate member 25 rests on one leg of Z-shaped stiffener member 32 and the end of the wallboard 36 butts against the member 25, holding the assembly together.

The head member 14 has a drip lintel 37 which is generally Z-shaped, having two legs 38 and 39 generally parallel to each other and connected together by intermediate member 40. The drip trough 41 is made up of outwardly-extending legs 42 and upwardly-extending leg 43 which, with leg 39, provides a trough. Caulking may be applied at 44 to the metal siding 29 and leg 40 as well as at 45 and 46. A self-drilling screw 47 connects leg 25 to a leg of the Z-shaped stiffener member 32.

The corner connection shown in FIG. 5 is made by cutting the legs 17 and 18 of the head member 14 and jamb member and strike members 11 and 12 at 45° along the line 52. A screw can be put into hole 48 in leg 20 and extend into leg 20 of the strike member 12. A similar joint can be made at the hinge member 11 and head member 14. A channel 49 may be used to tie the assembly to an overhead structural girder and to reinforce the strike and hinge members. The channel has web 50 connected to flanges 51 and 52. Flange 51 rests against the leg 28 of the channel member 23 and flange 52 may be supported against the leg 26.

The end of leg 24 may be bent upwardly at 53 and have two holes 54 therein for receiving two bolts 55 through the channel 49 and be clamped thereto by two nuts 60.

The foregoing specification sets forth the invention in its preferred, practical forms but the structure shown is capable of modification within a range of equivalents without departing from the invention which is to be understood is broadly novel as is commensurate with the appended claims.

The embodiment of the invention in which an exclusive property or privilege is claimed are defined as follows:

1. A door frame comprising a head section and two jamb sections, said sections each comprising an elongated generally channel shaped member and a generally Z-shaped stiffener member defining generally flat front wall and substantially flat side walls extending generally perpendicular to one side of said front wall, the outer end portion of said side walls being bent inwardly at approximately 90° forming a channel, the inner ends of said channel being bent toward said front wall forming a first inner end and a second inner end generally parallel to each other, a generally Z-shaped spacer approximately equal length to said front wall, said spacer having a first leg and a second leg disposed generally parallel to each other and to said side walls of said channel, one of said ends of the said Z-shaped spacer being adapted to be secured to one of the side walls of said channel and means for securing one of said end walls to said one side wall with an element supported therebetween.

2. The frame recited in claim 1 wherein said Z-shaped stiffener member has an intermediate member connecting said legs, said intermediate member having a connecting member disposed generally parallel to one of said inner ends of said Z-shaped spacer defining a space for the end of a sheet of wall material.

3. The frame recited in claim 2 wherein a Z-shaped stiffener is disposed between said spacer and said front wall of said channel shaped member, said stiffener having a first leg and a second leg disposed parallel to each other and resting on said first leg of said spacer and said front wall of said channel shaped member.

4. The frame recited in claim 3 wherein said head section has the generally Z-shaped drip cap resting on said spacer, said drip cap having two spaced legs, disposed generally parallel to each other, one said spaced leg being adapted to rest on a sheet of wall material, the other said spaced leg having a drip trough connected to the lower end thereof, the intermediate part of said drip cap resting on said Z-shaped stiffener member and a self drilling screw extending through said intermediate member of said drip cap and said intermediate member of said Z-shaped stiffener member.

5. The frame recited in claim 4 wherein said channel shaped members each having a rib formed on the intermediate member thereof providing a door stop.

* * * * *